US011168505B2

(12) United States Patent
Gherardi

(10) Patent No.: US 11,168,505 B2
(45) Date of Patent: Nov. 9, 2021

(54) MOTORIZED HINGE DEVICE

(71) Applicant: C.M.I. CERNIERE MECCANICHE INDUSTRIALI S.R.L., Valsamoggia (IT)

(72) Inventor: Eros Gherardi, Bologna (IT)

(73) Assignee: C.M.I. Cerniere Meccaniche Industrian S.R.L.

( * ) Notice: Subject to any disclaimer, the term of this patent is extended or adjusted under 35 U.S.C. 154(b) by 149 days.

(21) Appl. No.: 16/492,419

(22) PCT Filed: Mar. 14, 2018

(86) PCT No.: PCT/IB2018/000265
§ 371 (c)(1),
(2) Date: Sep. 9, 2019

(87) PCT Pub. No.: WO2018/167560
PCT Pub. Date: Sep. 20, 2018

(65) Prior Publication Data

US 2020/0240192 A1 Jul. 30, 2020

(30) Foreign Application Priority Data

Mar. 14, 2017 (IT) ..... 102017000028318

(51) Int. Cl.
*E05F 15/00* (2015.01)
*E05F 15/40* (2015.01)
*E05F 15/60* (2015.01)
*E05D 3/02* (2006.01)

(52) U.S. Cl.
CPC ..... *E05F 15/40* (2015.01); *E05D 3/02* (2013.01); *E05F 15/60* (2015.01);
(Continued)

(58) Field of Classification Search
CPC ..... E05F 5/06; E05F 5/006; E05F 5/02; E05F 1/12; E05F 3/20; E05F 1/1261;
(Continued)

(56) References Cited

U.S. PATENT DOCUMENTS 7,934,290 B2 * 5/2011 Gherardi ..... F24C 15/023 16/288
9,145,722 B2 * 9/2015 Gherardi ..... E05D 11/00
(Continued)

FOREIGN PATENT DOCUMENTS

WO 2014/111827 A1 7/2014

OTHER PUBLICATIONS

International Search Report and Written Opinion of the International Search authority, International Application No. PCT/IB2018/000265, 10 pages.

*Primary Examiner* — Chi Q Nguyen
(74) *Attorney, Agent, or Firm* — Ware, Fressola, Maguire & Barber LLP

(57) ABSTRACT

A motorized hinge device (1) has a first connection means (3) assigned to be fixed to a structure or framework of an appliance, and connected, at least by means of a connecting rod means (5), to a second connection means (7) assigned to be fixed to a door of the appliance. This second connection means (7) is hinged to the first connection means (3) by means of a hinge pin means (11). An actuator (13) has a body (15) fixed to the first connection means (3) and a movable member (17) which is movable with respect to the body (15) and is connected to the connecting rod means (5). In an operative condition, the actuator means (13) is operated to move, by means of the connecting rod means (5), the door around the hinge pin means (11) between extreme opening (A) and closing (C) conditions, and vice versa.

10 Claims, 4 Drawing Sheets

(52) U.S. Cl.
CPC ... *E05Y 2201/434* (2013.01); *E05Y 2201/686* (2013.01); *E05Y 2400/57* (2013.01); *E05Y 2900/304* (2013.01)

(58) Field of Classification Search
CPC ... E05F 3/04; E05F 15/63; E05F 15/40; E05F 15/1611; E05F 15/60; E05D 3/02; E05Y 2201/682; E05Y 2201/214; E05Y 2201/434; E05Y 2201/686; E05Y 2800/296; E05Y 2900/304; E05Y 2900/30; E05Y 2900/20; E05Y 2400/57; E05Y 2201/21; E05Y 2900/208
USPC ..... 49/26, 28; 16/287, 261, 71, 303; 126/191, 194
See application file for complete search history.

(56) References Cited

U.S. PATENT DOCUMENTS

| | | | | |
|---|---|---|---|---|
| 9,364,132 | B2 * | 6/2016 | Gherardi | E05F 1/1261 |
| 10,081,974 | B2 * | 9/2018 | Gherardi | E05F 1/12 |
| 10,244,920 | B2 * | 4/2019 | Vanini | E05F 1/1058 |
| 10,858,870 | B2 * | 12/2020 | Gherardi | E05F 1/1261 |
| 2003/0172920 | A1 * | 9/2003 | Gronbach | F24C 15/023 126/197 |
| 2011/0017191 | A1 * | 1/2011 | White | E05D 11/087 126/198 |
| 2013/0291853 | A1 * | 11/2013 | Braden | E05D 7/0423 126/19 R |
| 2015/0096148 | A1 * | 4/2015 | Gherardi | E05D 11/08 16/289 |

* cited by examiner

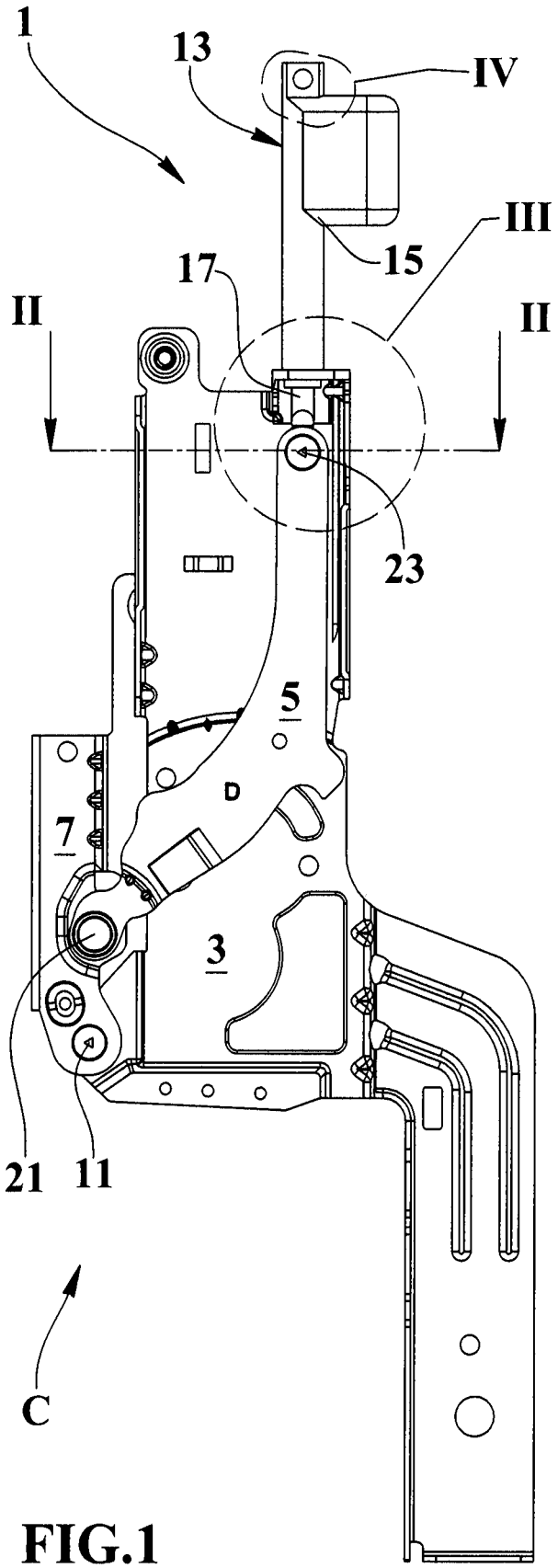
FIG.1
FIG.3
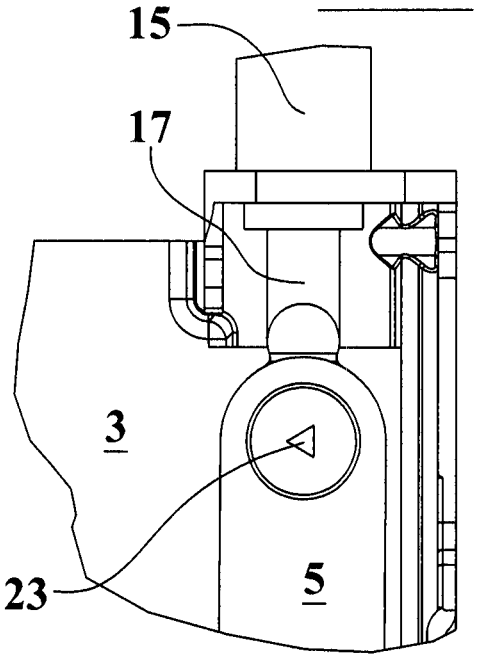
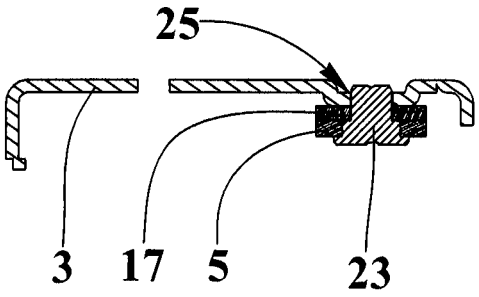
FIG.2
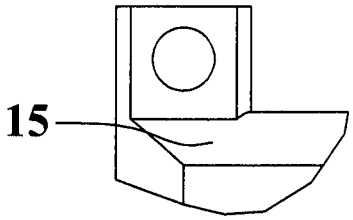
FIG.4

MOTORIZED HINGE DEVICE

TECHNICAL FIELD

The present invention is in the field of hinges for household appliances or furnishings and relates to a motorized hinge device particularly suitable for household appliances, such as dishwashers, with doors having horizontal, bottom rotation axes.

BACKGROUND ART

There are known hinges with horizontal rotation axes, for doors of household appliances and furnishings provided with elastic members and/or brakes assigned to balance the weights thereof, to slow down their strokes and/or to stabilize them in all positions, or in any given position, e.g., in the extreme closing and opening positions as well as in an intermediate steam-discharge position, or the like.

A drawback of such known devices is that in any case they require a manual operation for opening and closing.

Another drawback of the known devices is that since they are subject to very variable forces and handling-related stresses, they are to be so dimensioned as to withstand even the worst stresses, and, as a result, they are expensive, awkward and heavy.

Document WO 2014/111827 A1 discloses a motorized hinge for a door which covers at least in part a compartment, of the type comprising a fixed support coupled to the compartment frame, and a mobile support coupled to the door, wherein such mobile and fixed supports are at least rotatably constrained one to the other. The hinge also comprises means to impose a predefined law of motion to the mobile support with respect to the fixed support during opening and/or closing of the door and controlled motor means for aiding opening and/or closing of the door applying a push and/or a pull force onto the mobile support with respect to the fixed one.

DISCLOSURE OF INVENTION

An object of the present invention is to provide a motorized hinge device adapted to avoid damages to objects or persons interfering with the opening or closing path of the door.

A further object is to provide a device preventing damages of its parts in case of the door being blocked by an object.

Another object is to provide a device preventing damages of its parts in a case of the door being forced by a user who is trying to stop, to close or to open the door by hand.

Another object is to provide a device adapted to open and close the door or shutter on which it is mounted, following a respective electric command.

Another object is to provide a device adapted to stop the door or shutter in any desired intermediate position between the extreme opening and closing positions.

A further object is to provide a device adapted to avoid breaks even in the case that the rotation of the door or shutter is accidentally blocked, for example due to objects, children, animals or persons interfering with the opening or closing path.

Still another object is to provide a device that is reliable, compact and relatively cheap.

BRIEF DESCRIPTION OF DRAWINGS

The features of the invention are highlighted hereinbelow, with specific reference to the accompanying drawings, in which:

FIG. 1 shows a side view of a motorized hinge device embodiment of the present invention, in a closed condition;

FIG. 2 shows a section view along the plane II-II of FIG. 1;

FIGS. 3 and 4 show enlarged views of the details III and IV of FIG. 1;

DETAILED DESCRIPTION

Figure 5:
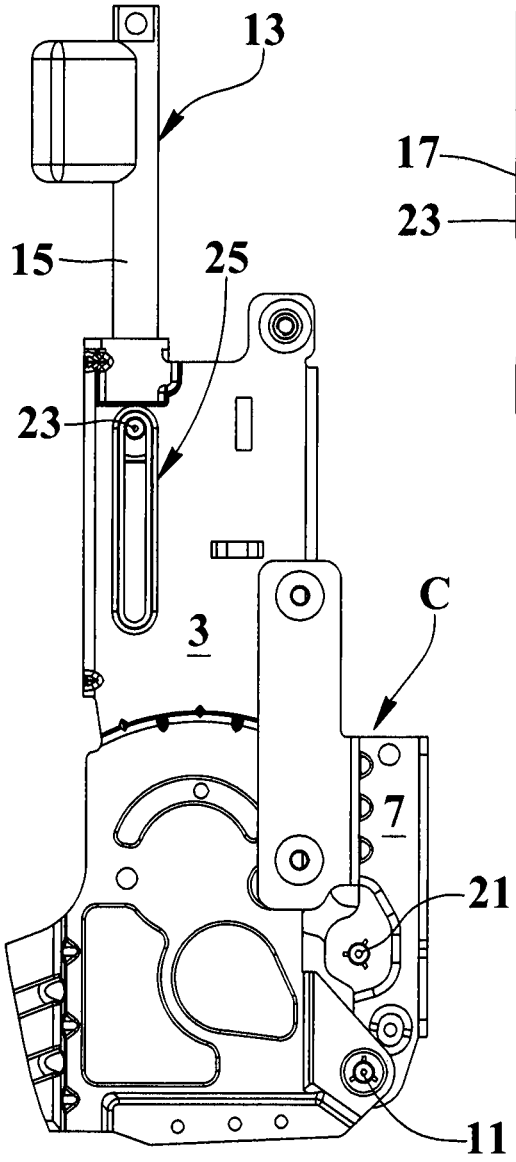
FIG. 5 shows a partial view of the device of FIG. 1, from the opposite side of said FIG. 1.
Figure 6:
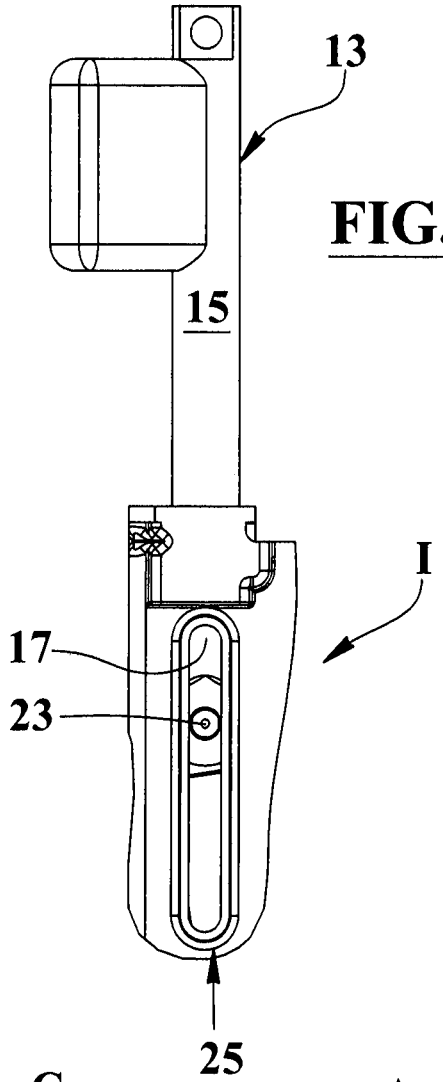
FIGS. 6 and 7 show partial, enlarged views of the device in FIG. 5, in the intermediate and open conditions, respectively.
Figure 7:
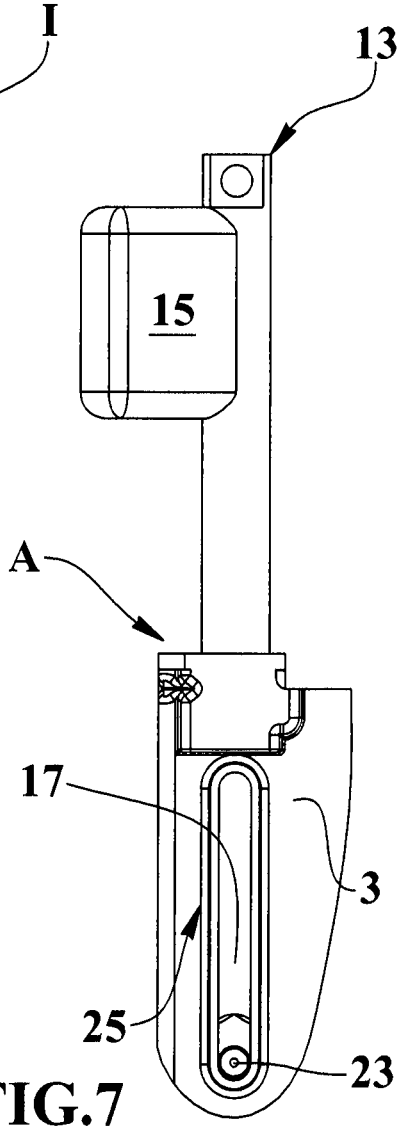
Figure 8:
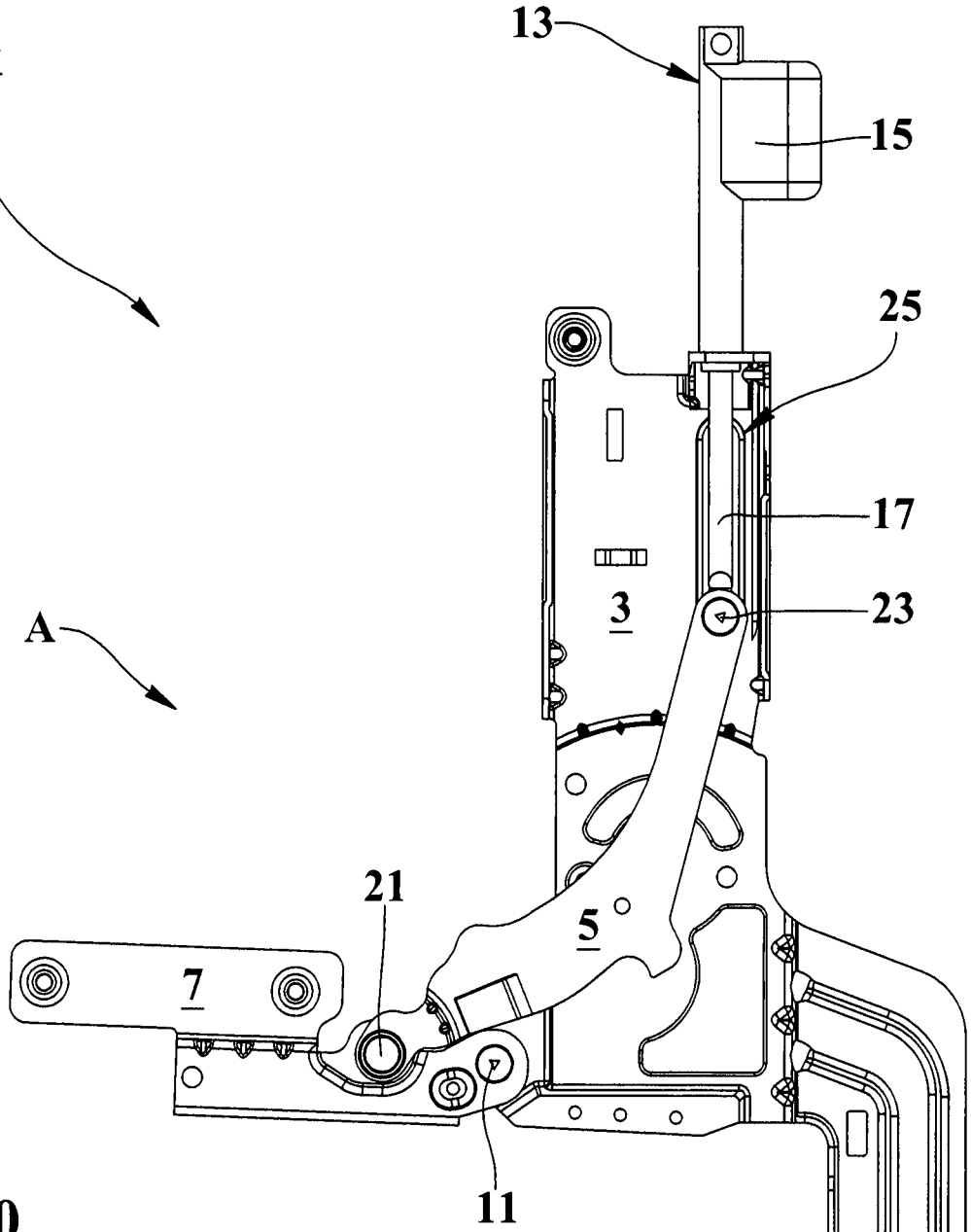
FIG. 8 shows the device in FIG. 1, in the open condition.
Figure 10:
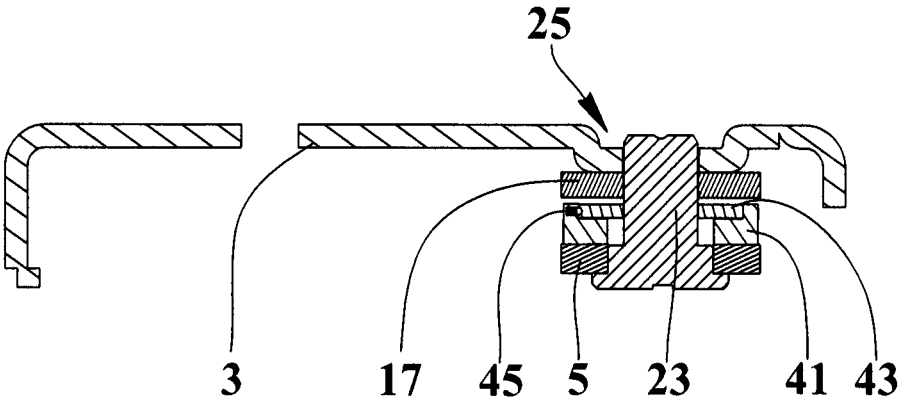
FIG. 10 shows possible variants of the details of the device in FIG. 2.
Figure 9:
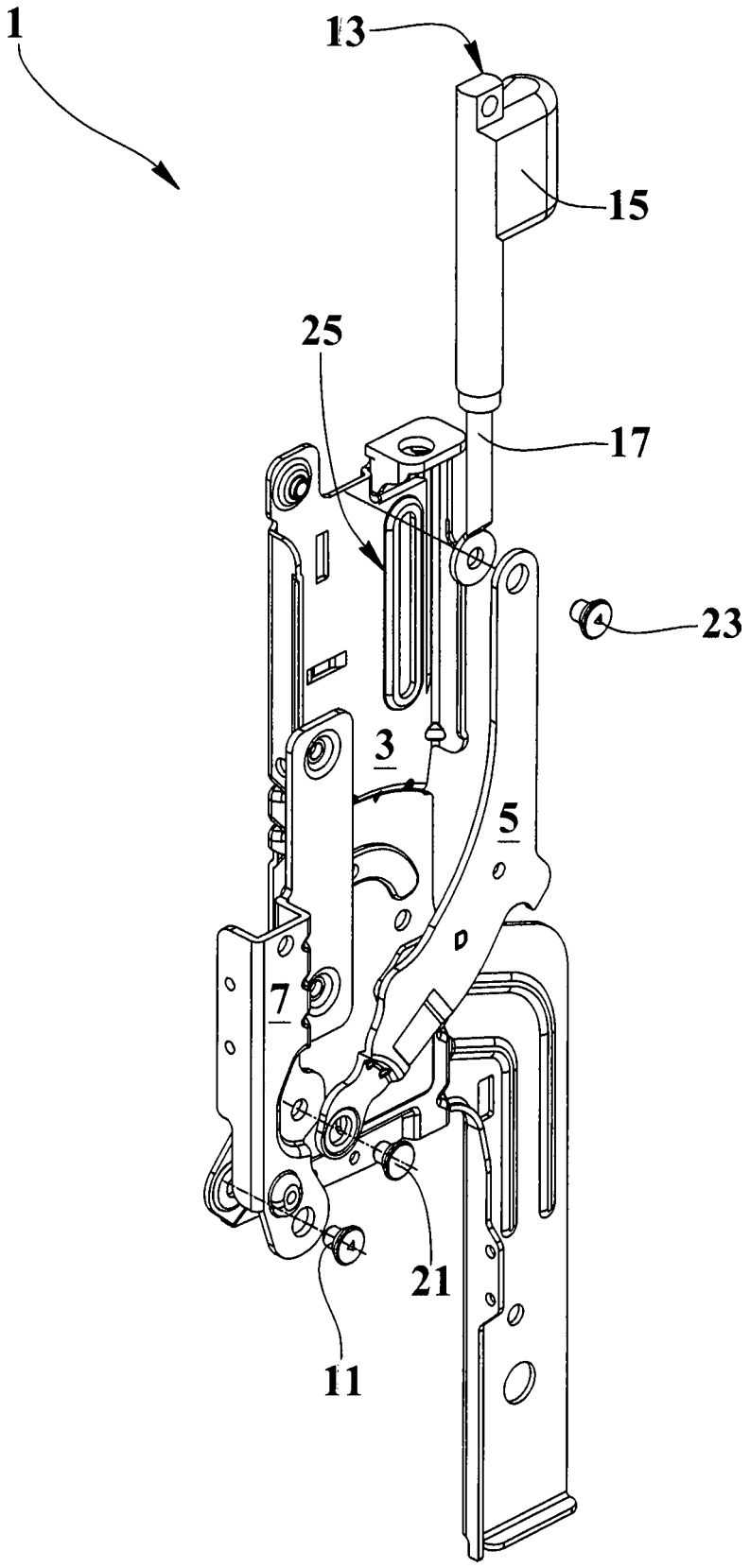
FIG. 9 shows an axonometric, exploded view of the device in FIG. 1.

Referring to FIGS. 1-9, numeral 1 denotes an embodiment of a motorized hinge device according to teachings of the present invention, comprising a first connection means 3 assigned to be fixed to a structure or a framework of an appliance, such as a dishwasher, and connected, at least by means of a connecting rod means 5, to a second connection means 7 assigned to be fixed to a door or a shutter of the appliance.

The second connection means 7 is hinged to the first connection means 3 by means of a hinge pin means 11.

The device 1 comprises at least one actuator means 13 having a body 15 fixed to the first connection means 3 or to a structure or a framework of the appliance, and a movable member 17 axially translating with respect to the body 15 upon operation of the actuator means itself.

The movable member 17 is connected to the connecting rod means 5.

The connecting rod means 5 is connected to the second connection means 7 by means of a first link pin means 21 having a rotation axis parallel to the rotation axis of the hinge pin means 11. This first link pin means 21 is accommodated, with little play, in respective holes obtained in an end of the connecting rod means 5 and in a specific protruding flat surface of the second connection means 7.

The movable member 17 of the actuator means 13 is connected to the connecting rod means 5 by means of a second link pin means 23 having an axis parallel to the axis of the hinge pin means 11.

In an operative condition of the device, the actuator means 13 is operated to move, by means of the connecting rod means 5, the door or shutter of the appliance around the hinge pin means 11, between extreme opening A and closing C conditions, and vice versa.

The second link pin means 23 is accommodated, with little play, in an end eyelet of the free end of the movable member 17 of the actuator means 13.

The axis of the second link pin means 23 is parallel to the axis of the hinge pin means 11.

The invention provides that the second link pin means 23 is connected to the connecting rod means 5 by means of drag means or by means of detachable coupling means and that the body 15 of the actuator means 13 is fixed to the first connection means 3 or to the structure, framework, chassis or body of the appliance.

In alternative, the invention provides that the second link pin means 23 is housed, with little play, in a respective seat hole of the connecting rod means 5 and the body 15 of the actuator means 13 is connected to the first connection means 3 or to the structure or framework of the appliance by means of said drag means or of said detachable coupling means.

In the operative condition said drag means or detachable coupling means limit the maximum force of the actuator transmissible to the door preventing damages in case the door is blocked by an object or being forced.

The detachable coupling means comprises a slider 43, for instance consisting of, or including, a block made of a material having a selected coefficient of friction, which slides along a channel or concave longitudinal sliding path of an elongated seat 41, for instance a metallic "C" section bar, parallel to a line of action of the actuator means 13 or inclined in respect to said line, of an angle smaller than 45°, preferably smaller than 20°.

Said elongated seat 41 is provided with a resilient or elastic and detachable stop 45.

This elastic stop 45 comprises a hollow housing transversely obtained in a wall of the elongated seat 41 and ending into the channel of the elongated seat 41. The housing accommodates a sphere and a spring that keeps such sphere elastically protruding from said end of the housing into said channel.

The slider 43 has at least one concavity assigned for elastically accommodating the sphere under normal conditions of use. In the event of an obstacle being interposed between the structure of the appliance and the door, such as an arm or a dish, during the closing process, where the latter is hampered by said arm or dish, beyond the coupling threshold between the slider 43 and the elongated seat 41, as determined by the elastic stop 45, there is an uncoupling of the actuator means 13 from the connecting rod means 5, so as to avoid the breaking of the appliance and/or damages to anything or to any person hindering the closing process.

The position of the hollow housing in the elongated seat 41 elastically stops the slider 43 in a middle or end position along the seat 41.

Such slider 43 is connected to the second link pin means 23 or, for instance by means of an appropriate pin or arm, to the body 15 of the actuator means 13.

The elongated seat 41, with its resilient stop, is fixed or integral to the connecting rod means 5 or to the first connection means 3 or to the structure or framework of the appliance.

The first connection means 3 or the structure or framework of the appliance or the connecting rod means 5 and the elongated seat 41 are provided with respective and mutually facing slots for the free sliding of the pin or arm connecting the body of the actuator to said slider 43 or for the free sliding of the second link pin means 23.

Said detachable stop 45 transmits a force, equal or smaller than a preset threshold, between the slider 43 and the elongated seat 41 rigidly transmitting the force of the actuator to the door; when said force exceeds said threshold, the sliding block is released by the detachable stop 45 and slides along the elongated seat 41 preventing damages in case of a block of the rotation of the door.

The end of the hollow housing opposite to the channel can be threaded and provided with a screw assigned to set the compression of the spring of the elastic stop 45 with which to set the threshold.

The drag means comprises a sliding block, for instance a lining for brake, frictionally sliding along a race, for instance a rail or an elongated concave score, parallel to a line of action of the actuator means 13 or inclined of an angle preferably smaller than 45°, where such sliding block is connected to the second link pin means 23 or to the body 15 of the actuator means 13.

The race is carried out in, or preferably fixed to, the connecting rod means 5 or to the first connection means 3 or to the structure or framework of the appliance.

In the operative condition, the drag means rigidly transmits the force of the actuator means to the connecting rod means 5 when said force is smaller than or equal to the static friction between the sliding block and the race; when said force exceeds said static friction, the sliding block slides along the race preventing damages in case of a block of the rotation of the door.

A protruding end of the second link pin means 23 is bound to slide along a guide means 25 made in, or fixed to, the first connection means 3; said guide means 25 is rectilinear and parallel to the line of action of the movable member 17 of the actuator means 13.

This guide means consists of a sliding slot for a protruding end of the second link pin means 23; alternatively, the guide means 25 may comprise a sliding guide or track for a carriage connected to the second link pin means 23.

The actuator means 13 is of an electric linear type, and the movable member 17 consists of a rectilinear stem axially translating when it enters or leaves the body 15 of the actuator means 13 itself.

Preferably, and as exemplarily shown in the Figures, the second link pin means 23 is fixed to the free end of the stem, and slides into the slot of the guide means 25, said slot being aligned with, or parallel to, the axis of the stem 17 of the actuator means.

The length and the position of the slot of the guide means 25 are given, so that in the extreme opening A and closing C conditions, the second link pin means 23 matches with the corresponding ends of this slot of the guide means 25, thus providing stops that prevent the door from rotating beyond said extreme conditions.

The invention provides that the device, and specifically the actuator means 13, is operated, for example, by control means of the household appliance, these means consisting of a timer or a digital programmer, e.g., of the programmable microprocessor type. It is also contemplated that the device may be provided with means for detecting the respective conditions of the device itself. For example, the first connection means 3 may comprise fixings for three detectors, for detecting the position of the connecting rod means 5, where a detector sends a signal to the control means when the connecting rod means 5 is in a position corresponding to the closed condition C; a second detector sends a signal when the door is in a steam-discharge, a grill, or another condition; and the third detector sends a signal upon reaching the extreme opening condition A. Each detector, for example, may consist of a micro-switch, an optoelectronic sensor, a Hall effect transistor fixed to a static member of the device, and a corresponding magnet fixed to a movable member of the device, or the like.

A further variant of the invention provides that the device is equipped with an angular sensor, e.g., a wire potentiometer, a circular encoder, or the like, with the frame fixed to the first connection means 3 and with the rotating member fixed to the second connection means 7, to communicate the instantaneous closing angle to the control means, the latter thus changing the speed of the actuator means 13 accordingly, and slowing it down, for example, in the vicinity of the extreme opening and closing conditions.

The invention claimed is:

1. A motorized hinge device (1) comprising a first connection means (3) fixed to a structure or a framework of an appliance, and connected by a connecting rod (5) to a second connection means (7) fixed to a door or a shutter of the appliance, and hinged to the first connection means (3) by a hinge pin (11), wherein said device (1) further comprises at least one actuator (13) having a body (15) fixed to the first connection means (3) or to the structure or the framework of the appliance, and a movable member (17) that is movable with respect to the body (15), and connected to the connecting rod (5), wherein in an operative condition, the actuator (13) is operated to move, by means of the connecting rod (5), the door or the shutter of the appliance around the hinge pin (11) between extreme opening (A) and closing (C) conditions, and a second link pin (23) is engaged in a respective eyelet carried out in the movable member (17) of the actuator (13) and is connected to the connecting rod (5), an axis of the second link pin (23) is parallel to an axis of the hinge pin (11); wherein said second link pin (23) is connected to the connecting rod (5) by a detachable coupling and the body (15) of the actuator (13) is fixed to or in respect to the first connection means (3); wherein in the operative condition said detachable coupling limits a maximum force transmissible from the actuator to the door preventing damages in case the door is blocked by an object or is forced; said detachable coupling comprising a slider (43) that slides along an elongated seat (41) parallel to a line of action of the actuator (13) or inclined of an angle smaller than 45° and the elongated seat (41) is provided with a resilient and detachable stop (45) for the slider (43) in a middle or end position of the seat (41); wherein the slider (43) is connected to the second link pin (23) and the elongated seat (41) with the resilient stop fixed or integral to the connecting rod (5); wherein the connecting rod (5) and the elongated seat (41) are provided with respective facing slots for free sliding of the second link pin (23); wherein said detachable stop (45) transmits a force, equal or smaller than a preset threshold, between the slider (43) and the elongated seat (41) rigidly transmitting the force of the actuator to the door, when said force exceeds said threshold, the sliding block slides along the race preventing damages in case of a block of a rotation of the door.

2. The motorized device according to claim 1, wherein an end of the connecting rod (5) is connected to the second connection means (7) by a first link pin (21) having a rotation axis parallel to a rotation axis of the hinge pin (11).

3. The motorized device according to claim 1, wherein the second pin (23) is connected to a free end of the movable member (17) of the actuator (13), and is connected to an end portion of the connecting rod (5) that is opposed to the first link pin (21); and wherein the second link pin (23) is bound to slide along a guide (25) made in, or fixed to, the first connection means (3).

4. The motorized device according to claim 3, wherein the guide guide (25) is rectilinear and parallel to a line of action of the movable member (17) of the actuator (13), and wherein the guide consists of one among a sliding slot for the second link pin (23) or a guide or sliding track for a carriage that is connected to the second link pin (23).

5. The motorized device according to claim 1, wherein the actuator is of a linear electric type, and wherein the movable member (17) consists of a rectilinear stem axially translating when the stem enters or leaves the body (15) of the actuator (13).

6. The motorized device according to claim 5, wherein the second link pin (23) is fixed to a free end of the stem and slides into the slot of the guide (25), said slot being aligned with, or parallel to, an axis of translation of the stem.

7. The motorized device according to claim 6, wherein in the extreme opening (A) and closing (C) conditions, the second link pin (23) matches with corresponding ends of the slot of the guide (25).

8. A motorized hinge device comprising a first connection means (3) fixed to a structure or a framework of an appliance, and connected, at least by means of a connecting rod (5), to a second connection means (7) fixed to a door or a shutter of the appliance, and hinged to the first connection means (3) by a hinge pin (11), said device further comprising at least one actuator (13) having a body (15) fixed to the first connection means (3) or to a structure or a framework of the appliance, and a movable member (17) that is movable with respect to the body (15), and connected to the connecting rod (5), wherein in an operative condition, the actuator (13) is operated to move by the connecting rod (5), the door or the shutter of the appliance around the hinge pin (11) between extreme opening (A) and closing (C) conditions, a second link pin (23) is engaged in a respective eyelet carried out in the movable member (17) of the actuator (13) and is connected to the connecting rod (5), wherein an axis of the second link pin (23) is parallel to an axis of the hinge pin (11); wherein said second link pin (23) is connected to the connecting rod (5) by means of drag means and the body (15) of the actuator (13) is fixed to or in respect to the first connection means (3); wherein in the operative condition said drag means limits a maximum force transmissible from the actuator to the door preventing damages in case the door is blocked by an object or being forced; said drag means comprising a sliding block frictionally sliding along a race parallel to a line of action of the actuator (13) or inclined of an angle smaller than 45°, wherein the sliding block is connected to the second link pin (23) and the race is fixed to the connecting rod (5); wherein in the operative condition, the drag means rigidly transmits the force of the actuator to the connecting rod (5) when said force is smaller or equal to static friction between the sliding block and the race; wherein when said force exceeds said static friction, the sliding block slides along the race preventing damage in case of a block of the rotation of the door.

9. A motorized hinge device comprising a first connection means (3) fixed to a structure or a framework of an appliance, and connected, at least by means of a connecting rod (5), to a second connection means (7) fixed to a door or a shutter of the appliance, and hinged to the first connection means (3) by a hinge pin (11), said device further comprising at least one actuator (13) having a body (15) connected to the first connection means (3) or to a structure or a framework of the appliance, and a movable member (17) that is movable with respect to the body (15), and connected to the connecting rod (5), wherein in an operative condition, the actuator (13) is operated to move, by means of the connecting rod (5), the door or the shutter of the appliance around the hinge pin (11) between extreme opening (A) and closing (C) conditions, a second link pin (23) is engaged in a respective eyelet carried out in the movable member (17) of the actuator (13) and is connected to the connecting rod (5), wherein an axis of the second link pin (23) is parallel to an axis of the hinge pin (11); wherein the second link pin (23) is engaged in a respective seat hole of the connecting rod (5) and the body (15) of the actuator (13) is connected to the first connection means (3) or to the structure or framework of the appliance by means of detachable coupling; wherein in the operative condition said detachable coupling limits a maximum force transmissible from the actuator to the door preventing damages in case the door is blocked by an object or is forced; wherein said detachable coupling comprises a slider (43) that slides along an elongated seat (41) parallel to a line of action of the actuator (13) or inclined of an angle smaller than 45° and provided with a resilient and detachable stop (45) for the slider (43) in a middle or end position of the seat (41); wherein the slider (43) is connected to the body (15) of the actuator (13) and the elongated seat (41) with the resilient stop fixed or integral to the first connection means (3) or to the structure or framework of the appliance; wherein the first connection means (3) or the structure or framework of the appliance and the elongated seat (41) are provided with respective facing slots for free sliding of a pin connecting the body of the actuator to said structure or of the second link pin (23); wherein said detachable stop (45) transmits a force, equal or smaller than a preset threshold, between slider (43) and the elongated seat (41) rigidly transmitting the force of the actuator to the door, when said force exceeds said threshold, the sliding block slides along the race preventing damage in case of a block in rotation of the door.

10. A motorized hinge device comprising a first connection means (3) fixed to a structure or a framework of an appliance, and connected, at least by means of a connecting rod (5), to a second connection means (7) fixed to a door or a shutter of the appliance, and hinged to the first connection means (3) by a hinge pin (11), said device comprising at least one actuator (13) having a body (15) connected to the first connection means (3) or to a structure or a framework of the appliance, and a movable member (17) that is movable with respect to the body (15), and connected to the connecting rod (5), wherein in an operative condition, the actuator (13) is operated by the connecting rod (5) to move, the door or the shutter of the appliance around the hinge pin (11) between extreme opening (A) and closing (C) conditions, wherein a second link pin (23) is engaged in a respective eyelet carried out in the movable member (17) of the actuator (13) and is connected to the connecting rod (5), wherein an axis of the second link pin (23) is parallel to an axis of the hinge pin (11; wherein said second link pin (23) is engaged in a respective seat hole of the connecting rod (5) and the body (15) of the actuator (13) is connected to the first connection means (3) or to the structure or framework of the appliance by drag means; wherein in the operative condition said drag means limits a maximum force transmissible from the actuator to the door preventing damage in case the door is blocked by an object or is forced; wherein said drag means comprises a sliding block frictionally sliding along a race parallel to a line of action of the actuator (13) or inclined of an angle smaller than 45°, wherein the sliding block is connected to the body (15) of the actuator (13) and the race is fixed to the first connection means (3) or to the structure or framework of the appliance; wherein in the operative condition, the drag means rigidly transmits the force of the actuator to the connecting rod (5) when said force is smaller or equal to static friction between the sliding block and the race; wherein when said force exceeds said static friction, the sliding block slides along the race preventing damages in case of a block in rotation of the door.

* * * * *